US009033541B2

(12) United States Patent
Porter

(10) Patent No.: US 9,033,541 B2
(45) Date of Patent: May 19, 2015

(54) TENSION MOUNTED LIGHTING SYSTEM

(75) Inventor: Derek Porter, Kansas City, MO (US)

(73) Assignee: Derek Porter Studio, Inc., Kansas City, MO (US)

( * ) Notice: Subject to any disclaimer, the term of this patent is extended or adjusted under 35 U.S.C. 154(b) by 586 days.

(21) Appl. No.: 13/348,312

(22) Filed: Jan. 11, 2012

(65) Prior Publication Data

US 2013/0176719 A1 Jul. 11, 2013

(51) Int. Cl.

| | |
|---|---|
| ***F21V 21/00*** | (2006.01) |
| ***F21S 4/00*** | (2006.01) |
| ***F21V 17/00*** | (2006.01) |
| *F21V 7/00* | (2006.01) |
| *F21V 19/00* | (2006.01) |
| *F21Y 101/02* | (2006.01) |
| *F21Y 103/00* | (2006.01) |

(52) U.S. Cl.

CPC ..... *F21S 4/003* (2013.01); *F21V 7/005* (2013.01); *F21V 17/007* (2013.01); *F21V 19/005* (2013.01); *F21Y 2101/02* (2013.01); *F21Y 2103/003* (2013.01)

(58) Field of Classification Search

USPC ..... 362/217.01, 252, 240

See application file for complete search history.

(56) References Cited

U.S. PATENT DOCUMENTS

| | | | | |
|---|---|---|---|---|
| 3,584,822 | A * | 6/1971 | Oram | 248/160 |
| 6,846,094 | B2 * | 1/2005 | Luk | 362/249.06 |
| 2004/0085761 | A1 * | 5/2004 | Offiler et al. | 362/217 |
| 2009/0226656 | A1 * | 9/2009 | Crandell et al. | 428/40.1 |
| 2013/0128582 | A1 * | 5/2013 | Holec et al. | 362/249.02 |

* cited by examiner

*Primary Examiner* — Joseph L Williams

(74) *Attorney, Agent, or Firm* — Wood, Phillips, Katz, Clark & Mortimer

(57) ABSTRACT

A lighting system includes a longitudinal flexible metal strip which may be helically rolled, first and second clamps securing opposite ends of the metal strip to first and second selected locations, and a longitudinally extending strip with lights such as LEDs secured to one side of the longitudinal metal strip. The first and second clamps each include a clamp arm secured to a base by a ball and socket connection.

20 Claims, 4 Drawing Sheets

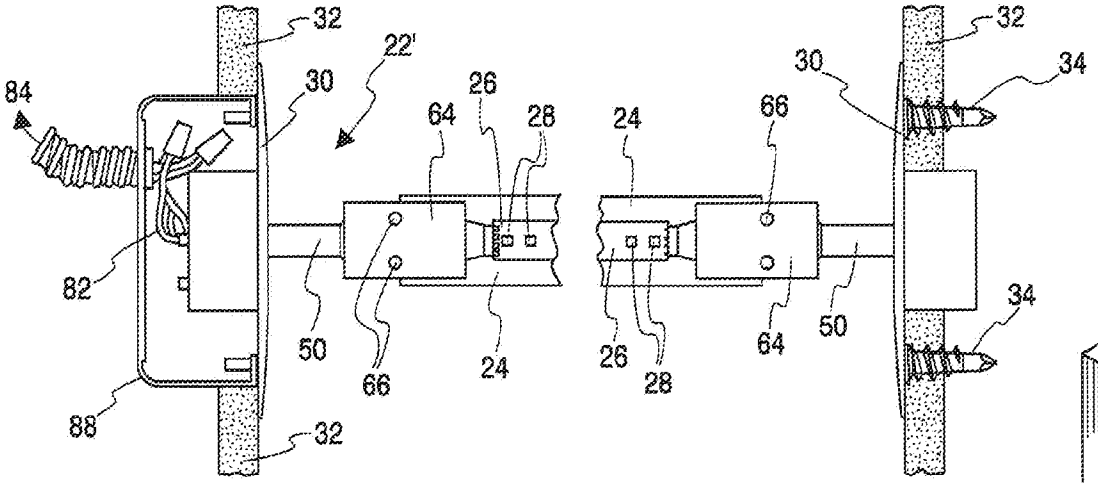
Fig. 7
Fig. 8
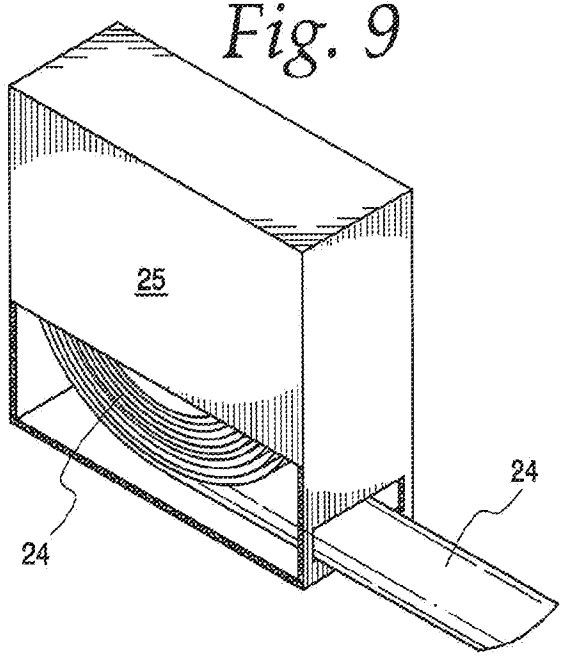
Fig. 9

TENSION MOUNTED LIGHTING SYSTEM

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

The present invention relates to light fixtures, and more particularly to linear light fixtures for lighting building interiors.

BACKGROUND OF THE INVENTION

Light fixtures are, of course, well known, and often used, including for both direct and indirect lighting (where, e.g., the light is directed from the fixture toward a surface such as a ceiling or wall, where reflected light from that surface provides the desired light in the area). Such fixtures include, for example, point sources of light as well as linear fixtures providing source along the length of the longitudinally extending fixture.

Linear fixtures providing a longitudinal source of light, whether direct or indirect, have often been suspended fluorescent linear lamps, with mounting of such lights limited to the drop points available in the ceilings as well as requiring high voltage enclosures. Also, such linear lamps typically have a fixed length, and are often greater than 2.5" in width and/or height, and therefore the length of the provided light is determined by the length of the lamp rather than the requirements of the area. Still further, shipping and handling (both during shipping and during installation) of such fixed length light fixtures can present problems, since most common transport services will not ship a package that is longer than 96 inches, requiring the end user to assemble a system in the field for lengths greater than 96 inches.

The present invention is directed toward overcoming one or more of the problems noted above.

SUMMARY OF THE INVENTION in one aspect of the present invention, a lighting system is provided, including a longitudinal flexible metal strip which may be helically rolled, first and second clamps securing opposite ends of the metal strip to first and second selected locations, and a longitudinally extending light strip secured to one side of the longitudinal metal strip.

In one form of this aspect of the present invention, the metal strip one side is reflective.

In another form of this aspect of the present invention, the first and second clamps secure the ends of the metal strip whereby the metal strip is supported in tension in a linear orientation along its length.

In still another form of this aspect of the present invention, the metal strip defines a concave channel along its length, wherein the light strip is secured in the channel. In a further form, the metal strip one side in the channel is generally light reflective.

In yet another form of this aspect of the present invention, the light strip includes a plurality of longitudinally spaced light emitting diodes (LEDs).

In another form of this aspect of the present invention, the first and second clamps each comprise a clamp arm secured to a base by a ball and socket connection, whereby the base includes the socket and is securable in a selected fixed position in an area, and the clamp arm has the ball on one end and clamping members on the other end adapted to secure to one end of the metal strip. In a further form, the metal strip is held in tension between the clamp arms of the first and second clamps, with the tension force on the clamp arms holding the clamp arms in the fixed positions.

In still another form of this aspect of the present invention, the first and second clamps each include an adjustably positionable clamp arm, the metal strip is held in tension between the clamp arms of the first and second clamps, and the tension force on the clamp arms secures the clamp arms in selected fixed positions.

In still another form of this aspect of the present invention, one of the first and second clamps includes a connector for connecting the light strip to a power source at the selected location of the clamp.

In yet another form of this aspect of the present invention, the light strip is secured to the metal strip by adhesive.

In another aspect of the present invention, a lighting system is provided, including a metal strip, first and second clamps securing opposite ends of the metal strip to first and second selected locations, and a longitudinally extending strip of light emitting diodes (LEDs) adhered to the metal strip in the channel. The metal strip is flexible whereby the strip may be helically rolled, and extends longitudinally between ends and defines a concave channel along its length.

In one form of this aspect of the present invention, the first and second clamps each include an adjustably positionable clamp arm, the metal strip is held in tension between the clamp arms of the first and second clamps, and the tension force on the clamp arms maintains the clamp arms in selected fixed positions.

In another form of this aspect of the present invention, the metal strip one side is reflective.

In still another form of this aspect of the present invention, the first and second clamps secure the ends of the metal strip whereby the metal strip is supported in tension in a linear orientation along its length.

In another form of this aspect of the present invention, the first and second clamps each comprise a clamp arm secured to a base by a ball and socket connection, whereby the base includes the socket and is securable in a selected fixed position in an area, and the clamp arm has the ball on one end and clamping members on the other end adapted to secure to one end of the metal strip. In a further form, each of the clamp arms is generally pivotable relative to their base around the center of the ball on the clamp arm end.

In still another form of this aspect of the present invention, one of the first and second clamps includes a connector for connecting the light strip to a power source at the selected location of the clamp.

In still another aspect of the present invention, a lighting system is provided for use in a building structure, including a metal strip, a first clamp secured to the first end of the metal strip, a second clamp secured to the second end of the metal strip, a longitudinally extending flexible light strip secured in the channel of the metal strip, and a box at one of the first and second clamps for connecting a power source to the light strip. The metal strip extends longitudinally between its first and second ends, defines a generally concave channel along its length, is flexible along its length, and is generally light reflective on the concave channel side. The first clamp includes a first base mountable to a first selected location of the building structure, and a first clamp arm. The first clamping arm has a first set of clamping members on one end adapted to secure the first clamp arm to the first end of the metal strip, and a first mount adjustably securable to the first base for securing the first clamping arm in a selected orientation relative to the first base. The second clamp includes a second base mountable to a second selected location of the building structure, and a second clamp arm. The second clamping arm has a second set of clamping members on one end adapted to secure the second clamp arm to the second end of the metal strip, and a second mount adjustably securable to the second base for securing the second clamping arm in a selected orientation relative to the second base.

In a further form of this aspect of the present invention, the metal strip is held in tension between the first and second clamp arms, and the tension force on the clamp arms secures the clamp arms in the selected orientations.

Other objects, features, and advantages of the invention will become apparent from a review of the entire specification, including the appended claims and drawings.

BRIEF DESCRIPTION OF THE DRAWINGS

FIG. 7 is a cross-sectional view of a lighting system clamp installed in a wall at the end providing power;

FIG. 8 is a cross-sectional view of the lighting system clamp installed in a wall at the opposite end of the system from the clamp of FIG. 7;

FIG. 9 is a partially broken-away view of a metal strip usable with the lighting system of the present invention helically wound in a box for storage, shipping and handling;

DETAILED DESCRIPTION OF THE PREFERRED EMBODIMENT

Figure 11:
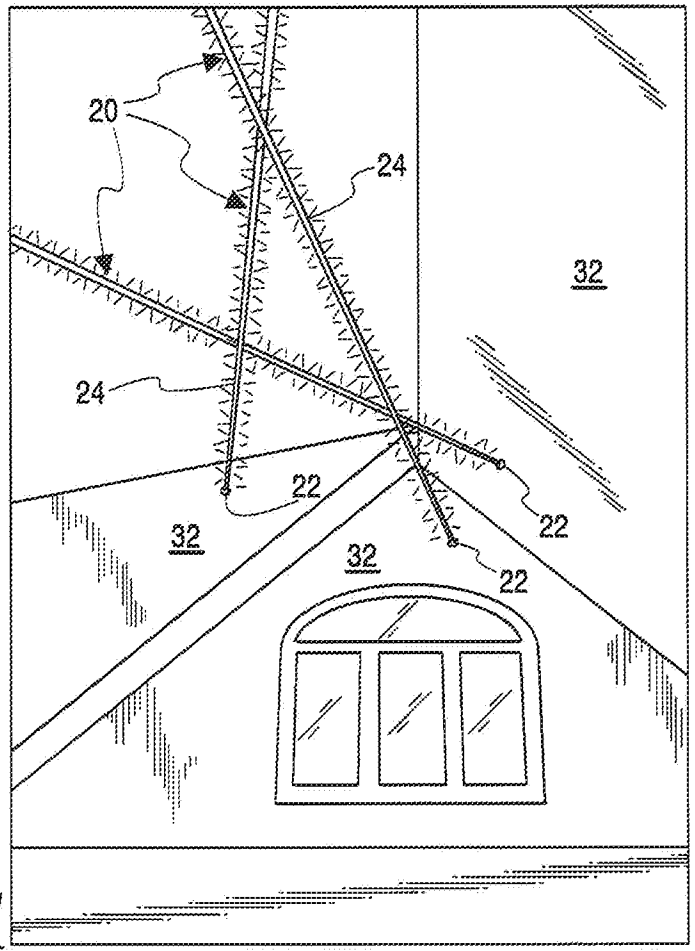
FIG. 11 is a view of another room in which a plurality of lighting systems according to the present invention are installed in a crossing orientation.
Figure 10:
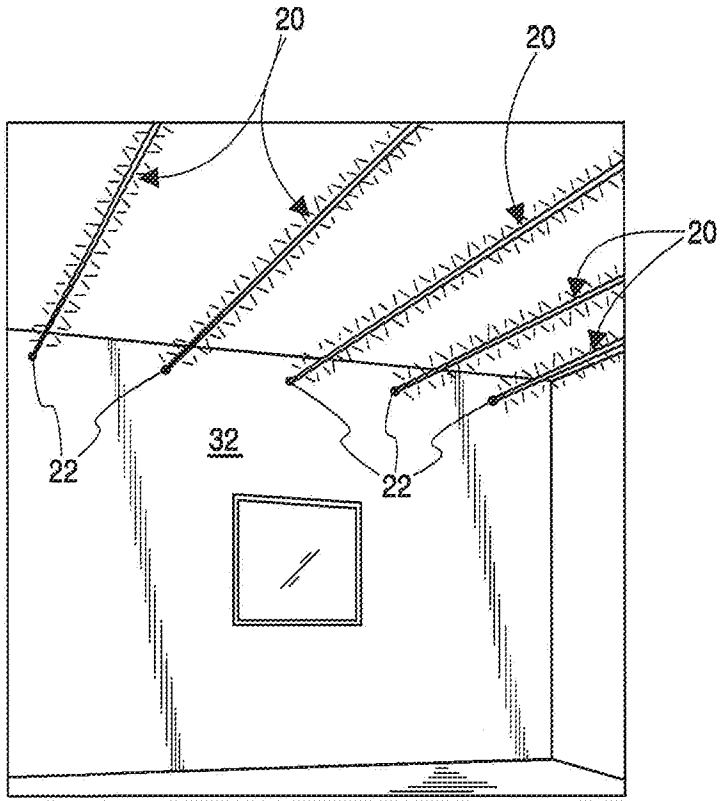
FIG. 10 is a view of a room in which a plurality of lighting systems according to the present invention are installed in a parallel orientation.

The lighting system or light fixture 20 of the present invention is variously illustrated in the Figures, including FIGS. 10-11 which illustrate rooms in which a plurality of the lighting systems 20 are installed. Broadly, the lighting system 20 consists of clamps 22 (see particularly FIGS. 1-4) which are fixed in selected positions in an area (e.g., to walls, ceiling or floor of a room in a building structure) and hold opposite ends of a flexible metal strip 24 (see particularly FIGS. 5-8) in tension therebetween. The flexibility of the metal strip 24 allows it to be helically rolled (see FIG. 9) so that it can be easily shipped and handled in a small box or other suitable container 25. A longitudinally extending and flexible light strip 26 (see particularly FIGS. 5-6) having light sources 28 such as light emitting diodes (LEDs) spaced along the length is secured to one side of the metal strip 24, whereby a light from multiple sources such as LEDs may be provided in a linear fashion over a length. It should be appreciated, however, that light strips providing light continuously over a length, whether with multiple point sources or a single continuous linear source, could be used within the broad scope of the present invention.

Figures 1, 2:
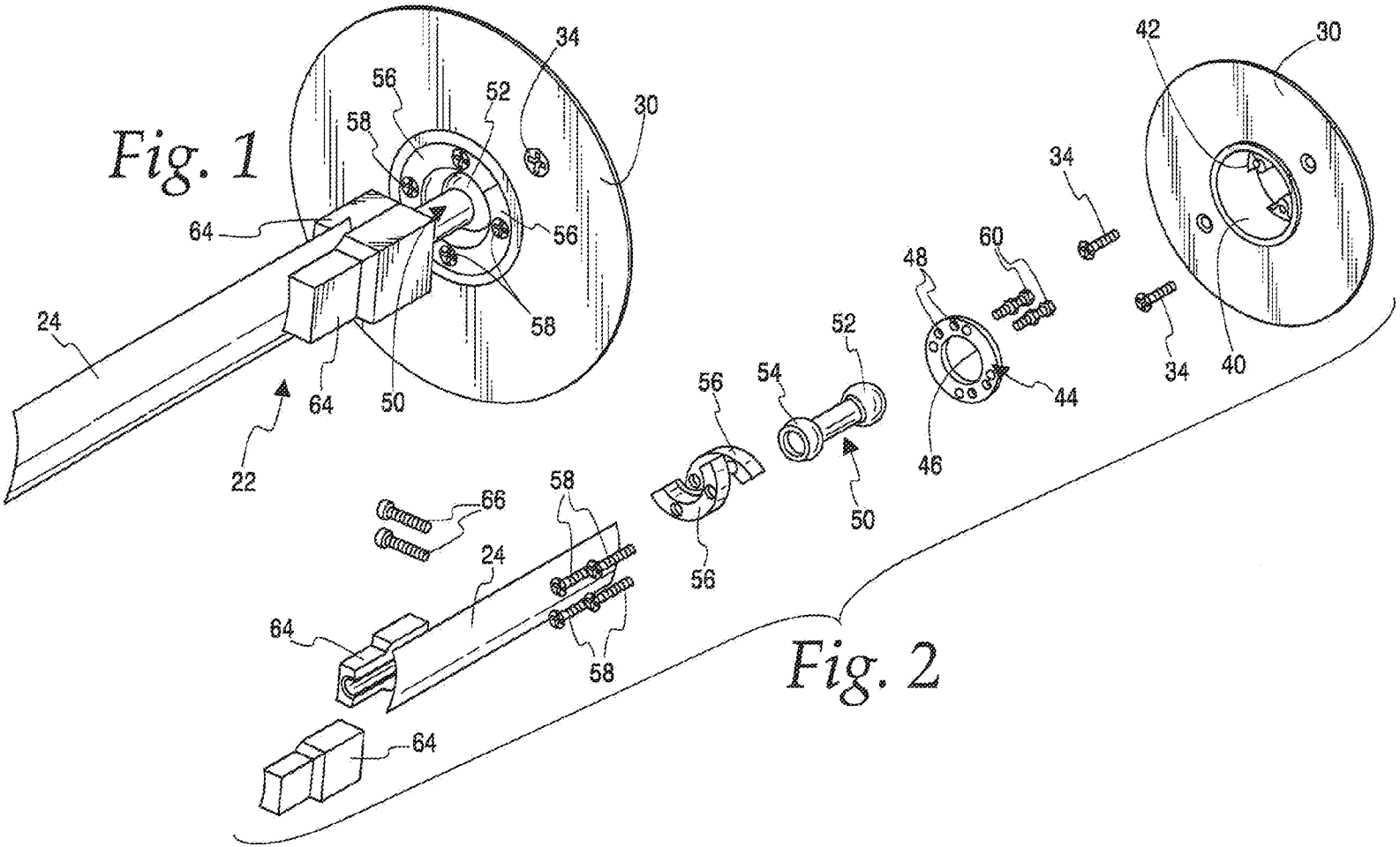
FIG. 1 is a perspective view of one end of a lighting system according to the present invention.
FIG. 2 is an exploded view of the lighting system one end of FIG. 1.
Figure 4:
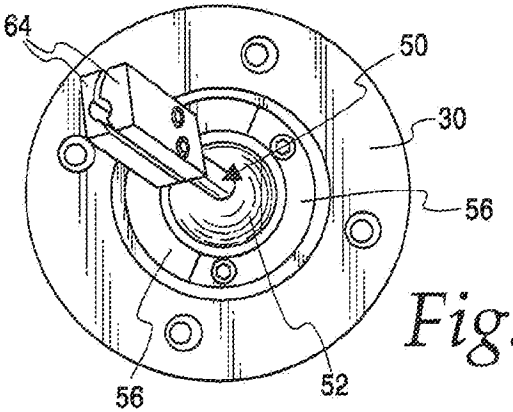
FIG. 4 is a front view of a lighting system clamp at the other end of the lighting system of the present invention.
Figure 3:
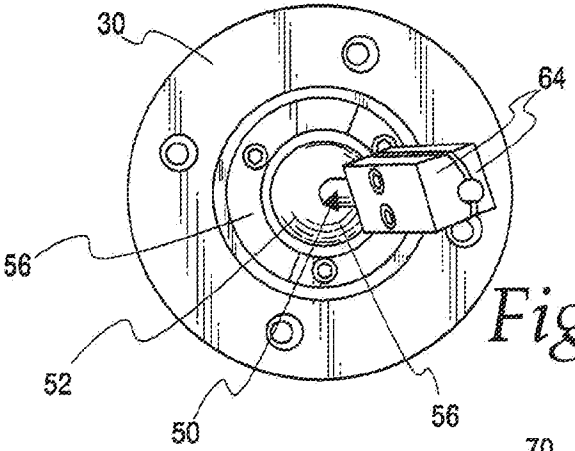
FIG. 3 is a front view of a lighting system clamp at one end of the lighting system of the present invention.

One suitable clamp or turnbuckle assembly 22 which may be suitably used with the present invention is illustrated in FIG. 2.

The clamp 22 includes a base 30 which may be suitably secured at a fixed location (e.g., secured to a wall 32 by screws 34 such as illustrated in FIG. 8). The base 30 includes a substantially cylindrical central opening 40 with a plurality of bosses 42 having threaded openings therein. A ring 44 having a round center opening 46 and screw holes 48 is secured on the bosses 42 in the base central opening 40 as described further below.

The clamp 22 also includes a clamp arm 50 which has balls 52, 54 at opposite ends. The ball 52 on one end is trapped against at the center opening 46 of the ring 44 in the base central opening 40 by a pair of arcuate members 56 secured over the ball 52, for example, by screws 58 extending through the ring screw holes 48 and arcuate members 56 and secured in the threaded openings of the bosses 42. A single ring may also be used in place of the pair of arcuate members 56. Spacer nuts and bolts 60 may also be secured to the ring 44 to limit the tightening of the arcuate members 56 toward the ring 44 and against the ball 52. This forms a ball and socket connection whereby the clamp arm 50 may move like a joystick relative to the base 30.

The ball 54 at the other end of the clamp arm 50 has a pair of clamping members 64 secured thereover (e.g., by screws 66 extending laterally therethrough). The clamping members 64 are adapted to clamp on opposite sides of the metal strip 24 to effectively form a second ball and socket connection. It should thus be appreciated that this configuration of clamp 22 provides some freedom of movement around both balls 52, 54 of the clamp arm 50 to facilitate the orientation of the clamp 22 in the desired longitudinal direction when the metal strip 24 is mounted between clamps 22. Moreover, when a metal strip 24 has been secured as desired, the clamps 22 may be secured in that desired position by tightening of the screws 58 and 66 to sufficiently squeeze the balls 52, 54 whereby friction will prevent movement from the desired position. It should be appreciated, however, that the tension of the metal strip 24 alone may be sufficient to maintain the clamps 22 in the desired orientation, without the need to frictionally bind the balls 52, 54 (e.g., by tightening the screws 58 and 66).

Figure 6:
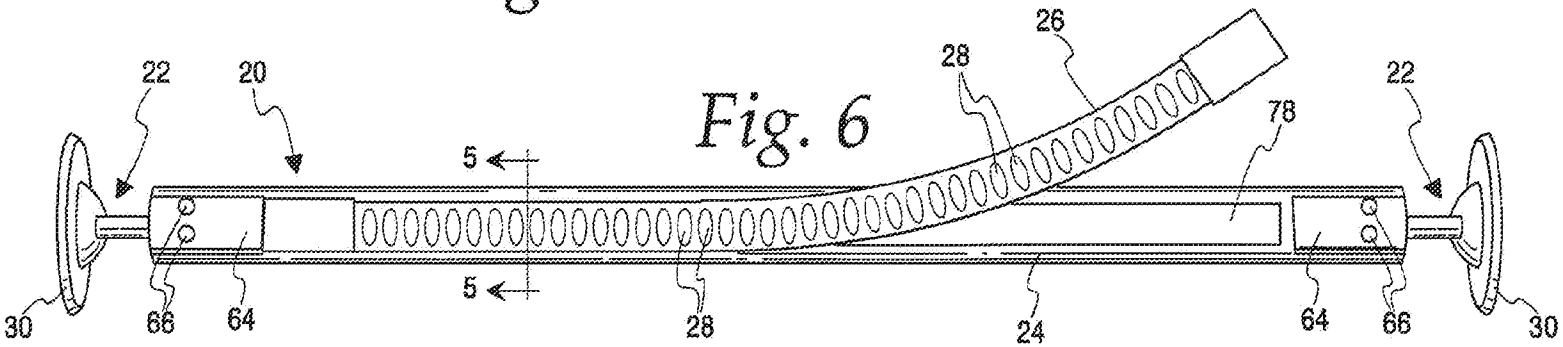
FIG. 6 is a top view of a lighting system according to the present invention, in which the light strip is shown being secured to the metal strip of the light fixture.

The metal strip 24 advantageously may be configured so that it is held in tension between two clamps 22, with the ends of the metal strip 24 suitably secured (e.g., by friction) between the clamping members 64 of each clamp 22 (see FIGS. 6-8). The clamping members 64 may, for example, include undulating surfaces to form and trap the ends of the metal strip 24. It should also be appreciated that any structure suitable for securing the ends of the metal strip 24 to each clamp arm 50 in the desired orientation could be advantageously used within the broad scope of the present invention.

Further, while in its most advantageous form, the metal strip would extend in a single linear direction between the clamps 22, it should also be appreciated that in other form the metal strip 24 may advantageously be configured so that it will retain its desired shape and orientation when secured between the clamping members 64. Thus, for example, whereas with the clamps 22 as illustrated, the metal strip 24 will be held in tension extending linearly between two clamps 22, it should also be appreciated that it would be in the broad scope of some aspects of the present invention to provide clamps which may be fixed in a desired orientation whereby the metal strip 24 could, if desired, be configured with two linear portions with a bend therebetween. Additionally, it should be appreciated that the present invention could be used, for example, with clamps without the adjustable arms 50 in installations which span two parallel surfaces (where, e.g., securing arms on the opposite surfaces could be fixed at ninety degree orientations relative to the parallel surfaces).

As previously noted, the metal strip 24 may be helically rolled for storage, shipping and handling, while still providing the desired stiffness to maintain the desired orientation (e.g., straight between two clamps 22). Preferably, the metal strip 24 is sufficiently flexible that it may be rolled into at least a three inch diameter without damage so that it will spring back to a straight configuration when unrolled. It has been found, that one suitable configuration includes a lateral curve, defining a longitudinal channel 70 (see FIG. 5) between the ends of the metal strip 24, somewhat like retractable tape measures.

Figure 5:
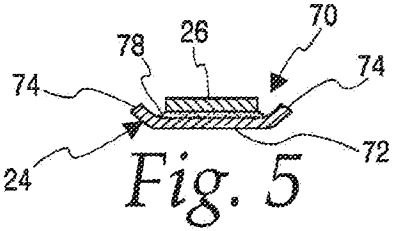
FIG. 5 is a cross-sectional view taken along line 5-5 of FIG. 6.

One particularly suitable metal strip 24 may be a longitudinal strip having a thickness of about 0.008 inch or greater and made of a 3000 series aluminum treated to a ¾ to full hard temper which allows the strip 24 to be rolled and un-rolled without losing its profile. As illustrated in FIG. 5, the channel 70 may have a flat center portion 72 having a width of about 0.5635 inch with upwardly curved sides 74 having a radius of about 1.5 inch whereby a channel depth of about 0.12 inch is provided over a strip width of about 1.267 inch. Still other materials, such as copper, could be used if desired (e.g., if the copper appearance is aesthetically desired notwithstanding its higher cost).

As illustrated in FIGS. 5-6, the light strip 26 may be secured in the channel 70 of the metal strip 24 by a suitable high tack adhesive 78. The flat center portion 72 of the channel 70 helps to provide orientation when applying the light strip 26 to the metal strip 24. It should be appreciated that in applications in which the lighting system 20 is used to provide indirect lighting (e.g., where the light is directed up toward a ceiling as illustrated in FIGS. 10-11), the light strip 26 will aesthetically be shielded from view by the curved sides 74 of the metal strip 24, so that only the smooth, continuous back side of the metal strip 24 will be visible to persons in the room. The curved sides 74 may also function as reflectors to help direct light where desired away from the channel side of the metal strip 24.

Preferably, the adhesive 78 should adhere to low energy surfaces and function suitably over long periods of time while encountering relatively high temperature. For example, where the light strip 26 includes LEDs 28, the adhesive 78 may encounter a continuous operating temperature of 90 degrees C. or greater, with heat being transferred to the metal strip 24 which additionally functions as a heat sink. For higher power density, for example, the adhesive 78 may advantageously have a thermal conductivity of 1.1 Wm/K or greater. Also, advantageously the adhesive 78 may, at times, electrically isolate the light strip 26 from the metal strip 24. It has been found that the adhesive 78 may advantageously be acrylic based, since such adhesives have high tack and will adhere well on most surfaces. Moreover, the adhesive 78 may be provided in any suitable form, including a two sided tape. One such suitable two sided tape is, for example, VHB™ tape available from 3M of St. Paul, Minn., U.S.A.

As illustrated in FIG. 7, at least one clamp 22' is configured to allow electrical power to be provided to the light strip 26. For example, a power cord 82 may be routed through the center of the clamp 22' to connect an external power source 84 to the light strip 26 at that end of the metal strip 24. A suitable box 88 may be provided for the wire connections.

It should be appreciated that lighting systems 20 according to the present invention will allow for unique and aesthetically pleasing light strips to be installed in virtually any open location, particularly where indirect lighting is desired. Moreover, it should be appreciated that installation of such lighting may be easily accomplished using the structure as described herein.

Still further, it should be appreciated that shipping, storage, handling and installation of such lighting systems 20 may be advantageously accomplished. That is, installations requiring long strips may be provided via use of a metal strip 24 which may be shipped and handled in a small box 25 such as illustrated in FIG. 9. Thus, shipping costs may be minimized as compared with long light structures requiring shipping of long components, and handling of the metal strip 24 during installation does not require handling of long, unwieldy components. Further, a long metal strip 24 may be provided in such a box 25, with required lengths of metal strip 24 cut from that long strip as required for each lighting system 20, without requiring that stiff, difficult to handle structures be cut to a needed length.

It should also be appreciated that lighting systems 20 according to the present invention will not require bulky high voltage enclosures such as required for linear fluorescent lamps, and instead a low voltage system having much less bulk may be used. Further, the reduction of size and bulk creates cleaner installations and, by being able to select the right combination of LED's, less power is consumed.

The invention claimed is:

1. A lighting system, comprising:

a metal strip extending longitudinally between ends, said metal strip being flexible whereby said strip is adapted to be rolled into a roll where said roll is cylindrical in shape with a roll width substantially equal to the width of said metal strip;

a first clamp securing one end of the metal strip to a first selected location;

a second clamp securing the other end of the metal strip to a second selected location with said metal strip unrolled into a substantially straight longitudinal orientation between said first and second clamps; and a light strip on one side of said longitudinal metal strip.

2. The lighting system of claim 1, wherein said metal strip one side is reflective.

3. The lighting system of claim 1, wherein said first and second clamps secure the ends of the metal strip whereby the metal strip is supported in tension in a linear orientation along its length.

4. The lighting system of claim 1, wherein said metal strip defines a concave channel along its length, wherein said light strip is in said channel.

5. The lighting system of claim 4, wherein said metal strip one side in said channel is generally light reflective.

6. The lighting system of claim 1, wherein said light strip includes a plurality of longitudinally spaced light emitting diodes (LEDs).

7. The lighting system of claim 1, wherein said first and second clamps each comprise a clamp arm secured to a base by a ball and socket connection, whereby the base includes the socket and is securable in a selected fixed position in an area; and the clamp arm has the ball on one end and clamping members on the other end adapted to secure to one end of the metal strip with said clamp arm oriented in the same direction as said longitudinal direction of said unrolled metal strip.

8. The lighting system of claim 7, wherein said metal strip is held in tension between the clamp arms of said first and second clamps, said tension force on said clamp arms holding said clamp arms in said fixed positions.

9. The lighting system of claim 1, wherein:

said first and second clamps each include an adjustably positionable clamp arm;

said metal strip is held in tension between the clamp arms of said first and second clamps, and said tension force on said clamp arms secures said clamp arms in selected fixed positions.

10. A method of installing the lighting system of claim 1 at a lighting site, comprising the steps of:

transporting a roll of metal strip to a lighting site;

unrolling a selected length of said metal strip to be substantially straight, wherein opposite ends of said selected length are said metal strip one and other ends;

securing said light strip to said one side of said selected length of said metal strip; and securing opposite ends of said metal strip selected length in said longitudinal orientation between said first and second clamps.

11. The lighting system of claim 1, wherein the first and second selected locations are separately fixed to a structure lighted by the lighting system.

12. A lighting system, comprising:

a metal strip extending longitudinally between ends and defining a concave channel along its length, said metal strip being flexible whereby said strip is adapted to be rolled into a roll where said roll is cylindrical in shape with a roll width substantially equal to the width of said metal strip;

a first clamp securing one end of the metal strip to a first selected location;

a second clamp securing the other end of the metal strip to a second selected location with said metal strip unrolled into a substantially straight longitudinal orientation between said first and second clamps; and light emitting diodes (LEDs) on said metal strip in said channel.

13. The lighting system of claim 12, wherein:

said first and second clamps each include an adjustably positionable clamp arm;

said metal strip is held in tension between the clamp arms of said first and second clamps, and said tension force on said clamp arms maintains said clamp arms in selected fixed positions.

14. The lighting system of claim 12, wherein said longitudinal metal strip one side is reflective.

15. The lighting system of claim 12, wherein said first and second clamps secure the ends of the metal strip whereby the metal strip is supported in tension in a linear orientation along its length.

16. The lighting system of claim 12, wherein said first and second clamps each comprise a clamp arm secured to a base by a ball and socket connection, wherein the base includes the socket and is securable at a selected fixed position in a building structure; and the clamp arm has the ball on one end and clamping, members on the other end adapted to secure to one end of the metal strip with said clamp arm oriented in the same direction as said longitudinal direction of said unrolled metal strip.

17. The lighting system of claim 16, wherein each of said clamp arms is generally pivotable relative to their base around the center of the ball on the clamp arm end.

18. A method of installing the lighting system of claim 12 at a lighting site, comprising the steps of:

transporting a roll of metal strip to the lighting site;

unrolling a selected length of said metal strip to be substantially straight, wherein opposite ends of said selected length are said metal strip one and other ends;

securing said light strip to said one side of said selected length of said metal strip; and securing opposite ends of said metal strip selected length in said longitudinal orientation between said first and second clamps.

19. A lighting system for use in a budding structure, comprising:

a flexible metal strip extending longitudinally between first and second and defining a generally concave channel along its length;

a first clamp secured the first end of the metal strip and including a first base mountable to a first selected location of the building structure, and a first clamp arm having a first set of clamping members on one end adapted to secure said first clamp arm to said first end of said metal strip, and a first mount adjustably securable to said first base for securing said first clamping arm in a selected orientation relative to said first base;

a second clamp secured to the second end of the metal strip and including a second base mountable to a second selected location of the building structure, and a second clamp arm having a second set of clamping members on one end adapted to secure said second clamp arm to the second end of said metal strip, and a second mount adjustably securable to said second base for securing said second clamping arm in a selected orientation relative to said second base;

a light strip in the channel of said metal strip; and a box at one of said first and second clamps for connecting a power source to said light strip;

whereby said metal strip is secured in a substantially straight longitudinal orientation between said first and second clamps.

20. The lighting system of claim 19, wherein said metal strip is held in tension between said first and second clamp arms, and said tension force on said clamp arms secures said clamp arms in said selected orientations.

* * * * *

UNITED STATES PATENT AND TRADEMARK OFFICE

CERTIFICATE OF CORRECTION

PATENT NO. : 9,033,541 B2
APPLICATION NO. : 13/348312
DATED : May 19, 2015
INVENTOR(S) : Derek Porter It is certified that error appears in the above-identified patent and that said Letters Patent is hereby corrected as shown below:

In the Claims

Claim 19, (column 8, line 25), delete “budding” and substitute therefor “building”.

Signed and Sealed this
Twenty-second Day of September, 2015

Michelle K. Lee

Michelle K. Lee
*Director of the United States Patent and Trademark Office*